US011248400B2

(12) United States Patent
Roll et al.

(10) Patent No.: US 11,248,400 B2
(45) Date of Patent: Feb. 15, 2022

(54) DOOR HANDLE DEVICE FOR A DOOR OF A MOTOR VEHICLE, DOOR, AND MOTOR VEHICLE

(71) Applicant: Volkswagen Aktiengesellschaft, Wolfsburg (DE)

(72) Inventors: Andy Roll, Isenbuettel (DE); Arne Meyer, Tuelau (DE); Larissa Ludmann, Cremlingen (DE); Stefan Weber, Braunschweig (DE); Peter Epping, Ibbenbueren (DE); Claudia Calmanti, Turin (IT); Claudio Scalvenzi, Turin (IT)

(73) Assignee: Volkswagen Aktiengesellschaft, Wolfsburg (DE)

( * ) Notice: Subject to any disclaimer, the term of this patent is extended or adjusted under 35 U.S.C. 154(b) by 719 days.

(21) Appl. No.: 16/141,328

(22) Filed: Sep. 25, 2018

(65) Prior Publication Data

US 2019/0093398 A1 Mar. 28, 2019

(30) Foreign Application Priority Data

Sep. 25, 2017 (DE) ..... 10 2017 216 920.6

(51) Int. Cl.
*E05B 77/04* (2014.01)
*E05B 79/06* (2014.01)
*E05B 85/16* (2014.01)

(52) U.S. Cl.
CPC ..... *E05B 77/04* (2013.01); *E05B 79/06* (2013.01); *E05B 85/16* (2013.01)

(58) Field of Classification Search
CPC ..... E05B 77/02; E05B 77/04; E05B 77/06; E05B 79/06; E05B 85/14; E05B 85/16; E05B 85/18
See application file for complete search history.

(56) References Cited

U.S. PATENT DOCUMENTS 8,424,936 B2 * 4/2013 Muller ..... E05B 77/06 292/336.3
9,567,777 B1 * 2/2017 VandenBrink ..... E05B 85/16
(Continued)

FOREIGN PATENT DOCUMENTS

CN 204175066 U 2/2015
CN 105696876 A 6/2016
(Continued)

OTHER PUBLICATIONS

Mar. 20, 2011 Machine translation for KR20110032508A (Year: 2011).*

*Primary Examiner* — Christine M Mills
*Assistant Examiner* — Christopher F Callahan
(74) *Attorney, Agent, or Firm* — Muncy, Geissler, Olds & Lowe, P.C.

(57) ABSTRACT

A door handle device for a door of a motor vehicle, with a bearing bracket attachable/attached to the door, with a door handle pivotally mounted on the bearing bracket, with an unlocking device that connects the door handle to the door lock so as to unlock the door lock upon actuation of the door handle, and with a blocking element, which is disposed on the bearing bracket in a release position releasing the unlocking device. The blocking element is at least partly displaceable into a blocking position preventing the unlocking device from unlocking so as to prevent opening of the door in an accident-related deformation of the door. It is provided that the blocking element is designed to be plastically and/or elastically deformable at least in sections such that the blocking element is movable into the blocking position at least in sections in the direction of the bearing bracket.

9 Claims, 3 Drawing Sheets

(56) References Cited

U.S. PATENT DOCUMENTS

| | | | | |
|---|---|---|---|---|
| 2013/0234455 | A1* | 9/2013 | Rocci | E05B 85/16 292/336.3 |
| 2014/0232122 | A1 | 8/2014 | Schnetter et al. | |
| 2016/0168882 | A1 | 6/2016 | Chung | |

FOREIGN PATENT DOCUMENTS

| | | | | | |
|---|---|---|---|---|---|
| DE | 102005049142 | A1 | | 4/2007 | |
| DE | 102008034460 | A1 | | 12/2009 | |
| DE | 102008062213 | A1 | | 6/2010 | |
| DE | 102008062214 | A1 | | 7/2010 | |
| DE | 102011085510 | A1 | | 5/2013 | |
| KR | 20110032508 | A | * | 3/2011 | |
| KR | 101481309 | B1 | * | 1/2015 | E05B 77/06 |
| WO | WO-2011013242 | A1 | * | 2/2011 | E05B 77/06 |
| WO | WO-2017130606 | A1 | * | 8/2017 | E05B 77/06 |

* cited by examiner

DOOR HANDLE DEVICE FOR A DOOR OF A MOTOR VEHICLE, DOOR, AND MOTOR VEHICLE

This nonprovisional application claims priority under 35 U.S.C. § 119(a) to German Patent Application No. 10 2017 216 920.6, which was filed in Germany on Sep. 25, 2017, and which is herein incorporated by reference.

BACKGROUND OF THE INVENTION

Field of the Invention

The invention relates to a door handle device for a door of a motor vehicle, with a bearing bracket attachable/attached to the door, with a door handle pivotally mounted on the bearing bracket, with an unlocking device that connects the door handle to the door lock so as to unlock the door lock upon actuation of the door handle, and with a blocking element, which is disposed on the bearing bracket in a release position releasing the unlocking device, wherein the blocking element is at least partly displaceable into a blocking position preventing the unlocking device from unlocking, so as to prevent opening of the door in an accident-related deformation of the door.

Furthermore, the invention relates to a door with a door handle device of this kind, as well as to a motor vehicle having at least one door of this kind.

Description of the Background Art

In an accident-related deformation of the vehicle door, for example, in a side impact, it may happen that an unlocking device of the door is actuated by the deformation of the door and results in an operative connection of the door handle with the door lock, as a result of which the door lock shifts to an open position and the door is thus opened. Door handle devices prevent the unwanted or unintentional opening of the door in the event of an accident. For this purpose, door handle devices have been provided with a blocking device which has a blocking element which, in a motor vehicle accident, in particular when an object strikes the door or the door handle device of a motor vehicle, is displaced by the deformation of the door into a position blocking the unlocking device, so that the door lock is not opened or is no longer openable and the door is thereby locked.

DE 10 2008 062 214 A1 discloses a door handle device with a door handle which is pivotally mounted on a bearing bracket, and an unlocking device with which the door lock can be unlocked by pulling the door handle. If the vehicle door is deformed, a blocking element interacts with the unlocking device, as a result of which the unlocking of the vehicle door is blocked.

DE 10 2011 085 510 A1 discloses an actuating device for actuating a closing device of a vehicle, which has a mass element and a lock, which in the normal operating state are movable relative to each other. In an accident, the mass element and the lock is shifted relative to one another in a direction transverse to the adjusting direction, so that a relative movement of the mass element and lock is blocked such that the closing device cannot be actuated unintentionally as a result.

SUMMARY OF THE INVENTION

It is therefore an object of the present invention to provide a door handle device which, on the one hand, ensures an improved and more cost-effective blocking of the door of a motor vehicle in the blocking position in an accident-related deformation of the door and, on the other hand, ensures a reliable release of the unlocking device in the release position, so that a reliable blocking of the door handle device is achieved in an accident-related deformation of the door and inadvertent blocking of the unlocking device is prevented.

In an exemplary embodiment, a door handle device is provided that includes a bearing bracket attachable/attached to the door, a door handle pivotally mounted on the bearing bracket, an unlocking device that connects the door handle to a door lock so as to unlock the door lock upon actuation of the door handle, and a blocking element which is disposed on the bearing bracket in a release position releasing the unlocking device, and is characterized in that the blocking element is at least partly displaceable into a blocking position preventing the unlocking device from unlocking so as to prevent opening of the door, in particular the unwanted opening of the door, in an accident-related deformation of the door, for example, a side impact. In the blocking position, the blocking element thus changes the relative position to the bearing bracket, in particular by deformation of door elements, so that it engages in the unlocking device and thereby prevents or blocks the actuation of the unlocking device. Advantageously, the door handle device of the invention leads to cost savings in providing a blocking element for preventing the opening of the door of a motor vehicle in an accident-related deformation of the door, because the installation of the blocking element on the bearing bracket is particularly easy. Advantageously, the blocking element of the invention enables a weight saving by eliminating additional components and results in a particularly small and space-saving design for blocking the unlocking device. Due to the placement of the blocking element on the bearing bracket, the blocking element interacts with the bearing bracket such that the blocking element from the release position ensures that the blocking position is reliably reached if the door is deformed. For this purpose, the blocking element is designed to be plastically and/or elastically deformable at least in sections such that the blocking element is movable into the blocking position at least in sections in the direction of the bearing bracket. A blocking element designed to be plastically and/or elastically deformable is understood to be a blocking element that alters its shape by the action of an external force but does not break thereby; in particular the blocking element does not break off from the bearing bracket. The deformability of the blocking element therefore ensures that in an accident-related deformation of the door, for example, in a side impact, the blocking element is not broken by a force acting on the blocking element and continues to be available for blocking the unlocking device. It is achieved in particular due to the plastic deformability of the blocking element that the blocking element remains in the blocking position after the door has been deformed, because the plastic deformation is preferably irreversible. It is achieved in particular due to the elastic deformability of the blocking element that after the blocking element has been displaced into the blocking position by the deformation of the door, the blocking element can be displaced back into a release position releasing the release device, because the elastic deformation is preferably reversible.

The blocking element can have a fastening end disposed on the bearing bracket and a blocking section associated with the unlocking device. A particularly simple attachment of the blocking element to the bearing bracket is made possible by the fastening end of the blocking element said end which is disposed on the bearing bracket, which is particularly advantageous in the mounting of the door handle device. Preferably, the fastening end has at least one clip, a pin, a screw connection, a plug connection, or a latching element for locking the blocking element on the bearing bracket. The blocking element is held in an ideal position for blocking the unlocking device in an accident-related deformation of the door by the fastening end of the blocking element, said end being disposed on the bearing bracket; the blocking element is thus held spatially such that movement into the blocking position of the unlocking device is ensured. The blocking of the unlocking device, in particular of the counterweight, is achieved by the blocking section associated with the unlocking device; in this case, the blocking section cooperates with the unlocking device such that movement of the blocking portion in the direction of the bearing bracket leads to a blocking position preventing the unlocking device from unlocking. Preferably, the blocking section extends partly or completely over the area of the blocking element. Preferably, the blocking section is formed as a rigid element. This allows the blocking section to engage firmly in the unlocking device.

The blocking section can be designed as a free end of the blocking element. The design of the blocking section as a free end of the blocking element achieves in particular that the blocking section in the release position is at a distance from the bearing bracket of the unlocking device and is displaceable into the predetermined position for ideal achievement of the blocking position.

The unlocking device can have a counterweight associated with the door handle, and that the blocking element with the blocking section extends at least partly over the counterweight. In an accident-related deformation of the door, the blocking element is preferably pushed into the counterweight and/or engages in the counterweight, wherein the blocking element is designed such that the blocking element prevents the counterweight from moving relative to the bearing bracket. As a result, in an accident-related deformation of the door, the positive blocking of the counterweight of the bearing bracket is advantageously made possible, as a result of which the counterweight can no longer move, in particular rotate, and the opening of the unlocking device is prevented.

The blocking element in the blocking section can have at least one blocking projection which engages in the counterweight in the blocking position, in particular in a positive manner, so as to prevent the counterweight from moving relative to the bearing bracket. An improved engagement of the blocking element in the counterweight, thus a particularly positive engagement in the counterweight, is achieved by the at least one blocking projection, so that the movement of the unlocking device, in particular the movement of the counterweight, is prevented. Preferably, in addition the at least one blocking projection is not deformable in an accident-related deformation of the door. Preferably, the at least one blocking projection is designed as a ball, rod, or pin.

At least the blocking section of the blocking element can be disposed on the bearing bracket side, facing away from the door handle. Because the blocking element is designed in particular smaller than the bearing bracket, there is the advantage that when the door is deformed from the outside, the forces acting due to the deformation are transmitted to the bearing bracket and this is moved overall in the direction of the inner body or door trim. This ensures a large-area force transmission from the door exterior trim to the bearing bracket and thus to the blocking element. If the blocking element is disposed on the bearing bracket side facing the door handle, which is theoretically also possible, however, a reduced impact surface is available due to the blocking element. The embodiment mentioned first thus achieves that the impact point on the outside of the door is less relevant for actuating the blocking element, because the probability that the bearing bracket is hit or moved along is greater due to the deformation of the door.

The blocking element in the region of the blocking section can have at least one actuating projection disposed on a side facing away from the blocking projection. A positive connection between the blocking element and the unlocking device is achieved by the at least one actuating projection in an accident-related deformation of the door, so that the unlocking device is blocked without a long time delay when the door is deformed. Preferably, the at least one actuating projection is designed as a raised area, rod, or pin.

The blocking element can be formed in one piece with the bearing bracket. The one-piece design of the blocking element with the bearing bracket further simplifies the mounting of the door handle device and eliminates an alignment of the blocking element on the bearing bracket, which results in a saving of time during mounting.

The door of the invention can have the door handle device of the invention, which has a support structure and at least one cladding element, in particular according to one of the exemplary embodiments described above. This results in particular in the advantages for the door or a vehicle having the door that have already been explained in connection with the door handle device.

The bearing bracket can be associated with the at least one cladding element such that the blocking element lies between the bearing bracket and the support structure of the door. This ensures that in the event of a corresponding deformation of the door, the blocking element is displaced into the blocking position by the forces acting from outside. Preferably, the door has a door frame element and an outer door panel, wherein the blocking element is disposed between the door frame element and the bearing bracket fastened to the outer door panel.

The blocking element can be movable in the transverse direction to the motor vehicle door, therefore, perpendicular to the bearing bracket. It is preferably provided that the at least one actuating element is fixedly connected to an element of the inside of the door, for example, the cladding element. Preferably, the actuating element is formed integrally with an element of the inside of the door. It is preferably provided that the door has a door frame element and an outer door panel, wherein the blocking element is disposed between the door frame element and the bearing bracket fastened to the outer door panel. This ensures that in an accident-related deformation of the door, the blocking element is displaced into the blocking position by the forces acting from outside or by a deformation of the outer door panel.

The motor vehicle of the invention can have at least one door of the invention. This results in particular in the advantages for the motor vehicle that have already been explained in connection with the door handle device and the door for a motor vehicle.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
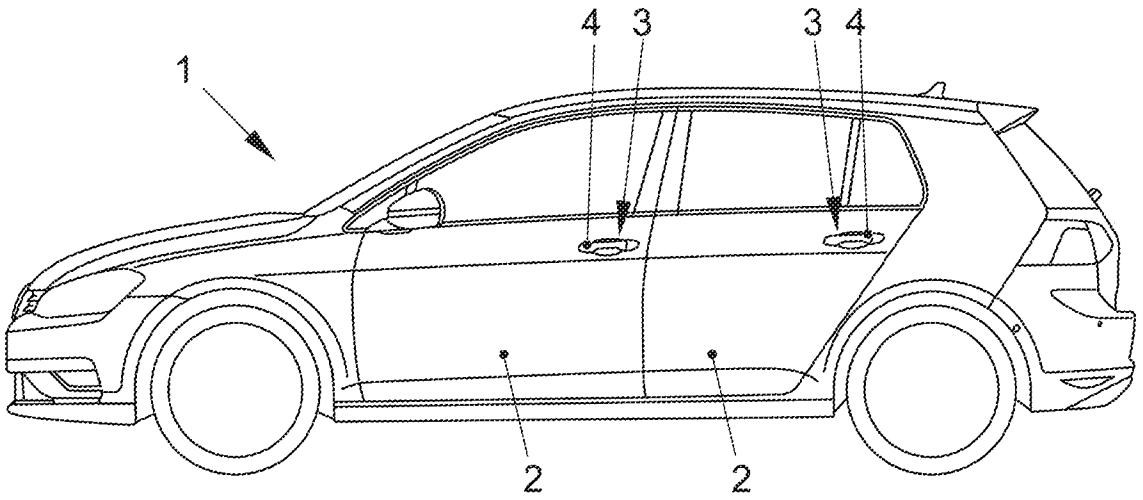
FIG. 1 shows a schematic illustration of a motor vehicle in a simplified side view.

FIG. 1 shows in a simplified side view a schematic illustration of a motor vehicle 1, which has a plurality of movable doors 2 for closing or releasing a door opening. In the closed state, doors 2 are fixedly articulated by a door lock in each case to the body or to a door frame of motor vehicle 1. In order to release the door lock, a door handle device 3 is disposed on each door. Both door handle devices 3 each have at least one exterior door handle 4, which is displaceable, wherein the respective door lock can be released or opened by its displacement. For this purpose, each door handle device 4 has an unlocking device 5, which mechanically connects door handle 4 to the door lock. A mechanical unlocking of the door lock can occur, for example, via the actuation of an internal or an external actuation Bowden cable of unlocking device 5.

Figure 2:
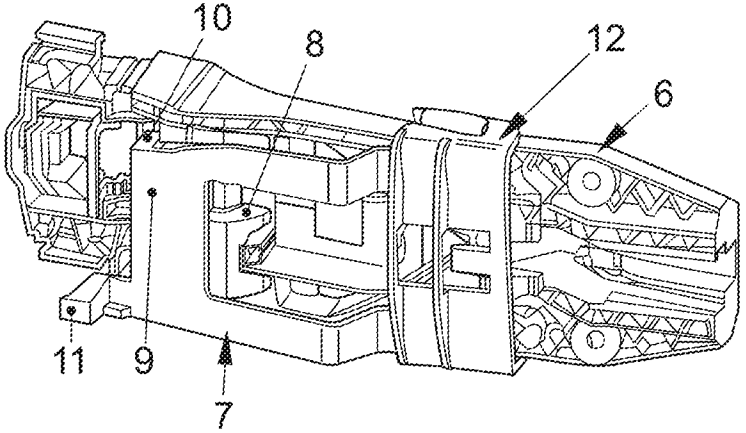
FIG. 2 shows a schematic illustration of a door handle device for a door of a motor vehicle in a perspective illustration.

FIG. 2 shows in a simplified schematic illustration a door handle device 3 for a door 2 of a motor vehicle 1 with a bearing bracket 6, with a blocking element 7, and with a movable counterweight 8. Bearing bracket 6 supports a door handle, which is pivotally held on bearing bracket 6. Counterweight 8 is used to counteract inertial forces which in an accident-related deformation of the door act on unlocking device 5 and produce a torque in a direction towards the opening of unlocking device 5, by generating an opposite torque, which compensates for the torque due to the inertial force, so that unlocking device 5 does not shift itself to another position. Unlocking devices of door handles in motor vehicles are basically known; unlocking device 5 present here can be designed in a conventional manner.

Blocking element 7 has a blocking section 9, a blocking projection 10, and an actuating projection 11. Blocking section 9 of blocking element 7 extends partly over counterweight 8 and in this exemplary embodiment interacts with counterweight 8 in an accident-related deformation of the door, for example, in a side impact. Blocking element 7 is attached to bearing bracket 6 by means of a fastening end 12 formed on blocking element 7. Fastening end 12 according to the present exemplary embodiment has a clip 15 which is designed to be pushed onto a retaining projection 16 of bearing bracket 6. In particular, clip 15 is designed to engage behind projection 16 in a latching manner. For this purpose, clip 15 is elastically expandable when pushed onto projection 16, so that when projection 16 is fully received behind it, due to its inherent elasticity it engages projection 16 in a locking manner. As a result, a simple mounting of blocking element 7 on bearing bracket 6 is ensured. According to an alternative exemplary embodiment, fastening end 12 has, instead of clip 15, a mounting pin or a locking element, which interacts with a receiving recess of bearing bracket 6 for latching locking of blocking element 7 on bearing bracket 6.

The blocking element is plastically and/or elastically deformable at least in sections, therefore, can be changed in its shape in a nondestructive manner, so that in particular blocking section 9 can be moved in the direction of counterweight 8 without blocking element 7 breaking thereby.

In an accident-related deformation of the door, blocking element 7 blocks counterweight 8, in particular by positive engagement, and thereby prevents opening of the door lock. Blocking element 7 is brought into engagement with counterweight 8 by contact of actuating element 11 with the door lock or other adjacent components and thereby leads to the blocking of unlocking device 5. The contact of actuating projection 11 is caused by the deformation of vehicle parts, for example, outer door panel 13. After a deformation of the door, blocking element 7 is plastically and/or elastically deformed at least in sections; preferably blocking section 9 is plastically and/or elastically deformed.

Figure 3:
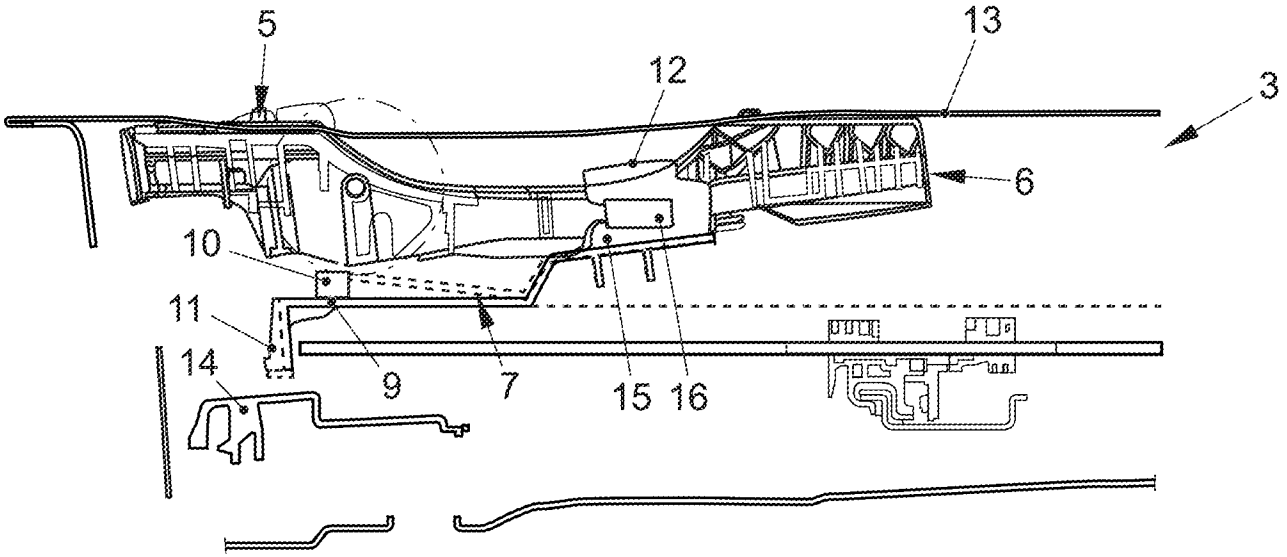
FIG. 3 shows a schematic illustration of a door for a motor vehicle with a door handle device in a perspective illustration.

FIG. 3 shows, in a simplified sectional view, door handle device 3 of door 2 of a motor vehicle 1. Bearing bracket 6 is attached to an outer door panel 13 of door 2. Bearing bracket 6 supports the door handle, which is pivotally disposed on bearing bracket 6. Blocking element 7 in the mounted state is disposed between bearing bracket 6 and a door frame element 14.

In an accident-related deformation of the door, for example, in a side impact, against outer door panel 13, outer door panel 13 is deformed in the region of door handle 3. Bearing bracket 6 attached to outer door panel 13 thereby moves with blocking element 7 in the direction of a door frame member 14. With sufficient force, blocking element 7, in particular actuating projection 11, is pressed thereby against door frame element 14. Actuating projection 11 enables an initial movement of blocking element 7 into a blocking position in unlocking device 5. The distance in the release position between blocking element 7 and bearing bracket 6 is reduced by the movement of blocking element 7 relative to bearing bracket 6, and blocking element 7 engages in counterweight 8 with blocking section 9, in particular with blocking projection 10, or pushes itself in front of counterweight 8 (see FIG. 2), so that it is prevented from moving relative to bearing bracket 6. Due to the prevention of the movement of counterweight 8 relative to bearing bracket 6 in the achieved blocking position, blocking element 7 prevents door handle device 3 from resulting in the opening of the door lock, therefore, in unlocking device 5 being displaced into a release position. This prevents the door from being able to open or to unlock automatically in an accident-related deformation of the door. Blocking element 7 is preferably held largely free of play on bearing bracket 6 in order to hold blocking element 7 firmly on bearing bracket 6 and to enable as little movement as possible of blocking element 7 relative to bearing bracket 6, so that an exact spatial engagement in bearing bracket 6, in particular in counterweight 8 of bearing bracket 6, is made possible in an accident-related deformation of the door.

Counterweight 8 is restricted or completely blocked in its movement by blocking element 7, and this thereby prevents the unlocking of the door lock. If door 2 or components of door 2 are deformed by an intruding barrier, blocking element 7 and bearing bracket 6 move in opposite directions. This can occur, for example, by the contact via an actuating projection 11 of blocking element 7 with the door lock or other components. Blocking projection 11 moves in bearing bracket 6, in particular in front of counterweight 8 or engages in counterweight 8. Counterweight 8 cannot move or rotate thereby, as a result of which no actuation of the external actuation Bowden cable occurs. Unlocking device 5 with the door lock associated therewith is thereby prevented from opening during an accident and remains locked.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A door handle device for a door of a motor vehicle, the door handle device comprising:

a bearing bracket attachable to the door;

a door handle pivotally mounted on the bearing bracket;

an unlocking device that connects the door handle to a door lock so as to unlock the door lock upon actuation of the door handle; and a blocking element arranged on the bearing bracket in a release position, wherein in the release position, the unlocking device is releasable, wherein the blocking element is at least partly displaceable into a blocking position to prevent the unlocking device from being released so as to prevent opening of the door in an accident-related deformation of the door, wherein the blocking element is plastically and/or elastically deformable at least in sections such that the blocking element is movable into the blocking position at least in sections in a direction of the bearing bracket, wherein the blocking element has a fastening end disposed on the bearing bracket and a blocking section associated with the unlocking device, wherein a first side of the blocking section of the blocking element has at least one blocking projection that extends therefrom, wherein a second side of the blocking section, that opposes the first side, has an actuating projection that extends therefrom, and wherein the blocking element is a monolithic structure.

2. The door handle device according to claim 1, wherein the blocking section is designed as a free end of the blocking element.

3. A door handle device for a door of a motor vehicle, the door handle device comprising:

a bearing bracket attachable to the door;

a door handle pivotally mounted on the bearing bracket;

an unlocking device that connects the door handle to a door lock so as to unlock the door lock upon actuation of the door handle; and a blocking element arranged on the bearing bracket in a release position, wherein in the release position, the unlocking device is releasable, wherein the blocking element is at least partly displaceable into a blocking position to prevent the unlocking device from being released so as to prevent opening of the door in an accident-related deformation of the door, wherein the blocking element is plastically and/or elastically deformable at least in sections such that the blocking element is movable into the blocking position at least in sections in a direction of the bearing bracket, wherein the blocking element has a fastening end disposed on the bearing bracket and a blocking section associated with the unlocking device, wherein a first side of the blocking section of the blocking element has at least one blocking projection that extends therefrom, wherein a second side of the blocking section, that opposes the first side, has an actuating projection that extends therefrom, wherein the unlocking device has a counterweight associated with the door handle, and wherein the blocking section of the blocking element extends at least partly over the counterweight.

4. The door handle device according to claim 3, wherein the at least one blocking projection engages, in a positive manner, the counterweight in the blocking position so as to prevent the counterweight from moving relative to the bearing bracket.

5. The door handle device according to claim 1, wherein at least the blocking section of the blocking element is disposed on a side of the bearing bracket that faces away from the door handle.

6. The door handle device according to claim 1, wherein the blocking element is formed in one piece with the bearing bracket.

7. A door for a motor vehicle comprising:

a support structure;

at least one cladding element; and the door handle device according to claim 1.

8. The door according to claim 7, wherein the bearing bracket is associated with the at least one cladding element, and wherein the blocking element lies between the bearing bracket and the support structure of the door.

9. A motor vehicle comprising at least one of the door according to claim 7.

* * * * *